US007165864B2

(12) United States Patent
Miller

(10) Patent No.: US 7,165,864 B2
(45) Date of Patent: Jan. 23, 2007

(54) LIGHTING FIXTURE WITH NIGHT LIGHT

(76) Inventor: Robert Glenn Miller, 5 12th Ave., San Mateo, CA (US) 94402

( * ) Notice: Subject to any disclaimer, the term of this patent is extended or adjusted under 35 U.S.C. 154(b) by 171 days.

(21) Appl. No.: 10/709,816

(22) Filed: May 30, 2004

(65) Prior Publication Data

US 2005/0265050 A1 Dec. 1, 2005

(51) Int. Cl.
*F21V 23/04* (2006.01)

(52) U.S. Cl. ..... 362/251; 362/276; 362/641; 362/802

(58) Field of Classification Search ..... 362/20, 362/251, 260, 276, 641, 802
See application file for complete search history.

(56) References Cited

U.S. PATENT DOCUMENTS 5,713,655 A * 2/1998 Blackman ..... 362/276
6,045,232 A * 4/2000 Buckmaster ..... 362/20
6,120,165 A * 9/2000 Shalvi ..... 362/276

* cited by examiner

*Primary Examiner*—Stephen F Husar
(74) *Attorney, Agent, or Firm*—Richard D. Fuerle

(57) ABSTRACT

A lighting fixture has a night light that is always on, a safety light that provides more light than the night light, and a sensor that detects the presence of a person within the area illuminated by the safety light. The sensor turns on the safety light when a person is detected within said area and turns off the safety light after the person is no longer detected within the area. In that way, ample light is provided for safety and security purposes while dramatically reducing the amount of energy used.

18 Claims, 5 Drawing Sheets

LIGHTING FIXTURE WITH NIGHT LIGHT

BACKGROUND OF INVENTION

This invention relates to an indoor lighting fixture equipped with a night light and a sensor. In particular, it relates to a lighting fixture that has a night light that is always on and a brighter safety light that comes on only when a sensor detects the presence of a person.

Buildings and indoor parking garages are required by law to have lights in the corridors and stairwells, both for security and for safety. While the UCB (Uniform Code for Buildings) requires these lights to be only one foot candle, the conventional practice is to use much brighter lights in order to reduce or avoid liability for inadequate lighting. The cost of electricity for these lights in a large building can be a significant expense.

SUMMARY OF INVENTION

The lighting fixture of this invention conserves energy and reduces the cost of lighting corridors and stairwells in buildings such as office buildings, apartment buildings, hospitals, parking garages, and other facilities. The fixture has a night light that is continuously on, providing the minimum amount of light needed to comply with building regulations. The fixture also has a sensor that can detect the presence of a person. When a person is detected, a brighter safety light is turned on to provide ample light in the area. Once the person leaves, the safety light is turned off. Since the night light uses very little electricity and the safety light is usually on only very infrequently, the amount of electricity used for lighting corridors and stair-wells in buildings is cut dramatically.

DETAILED DESCRIPTION

Figure 1:
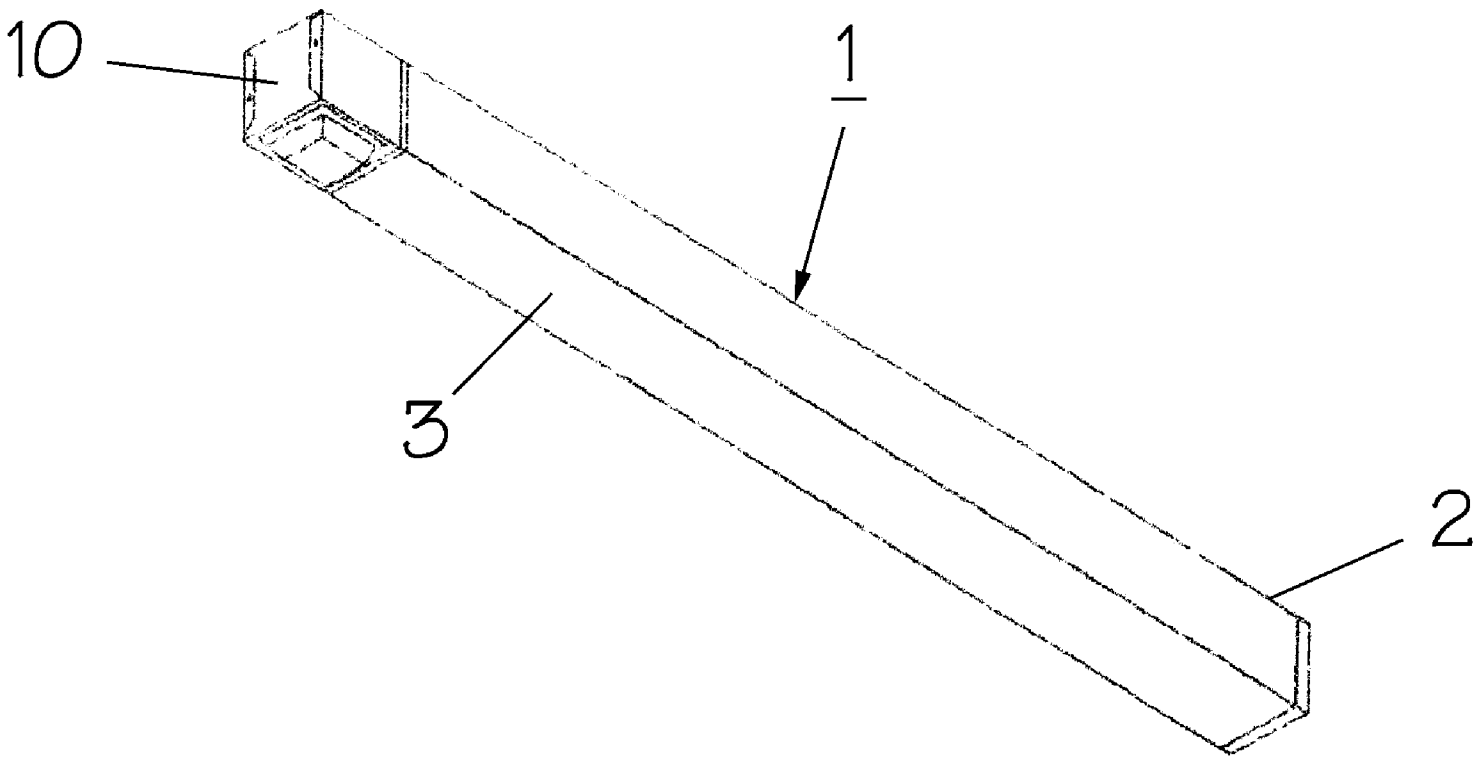
FIG. 1 is an isometric view of a certain presently preferred embodiment of a lighting fixture according to this invention.
Figure 2:
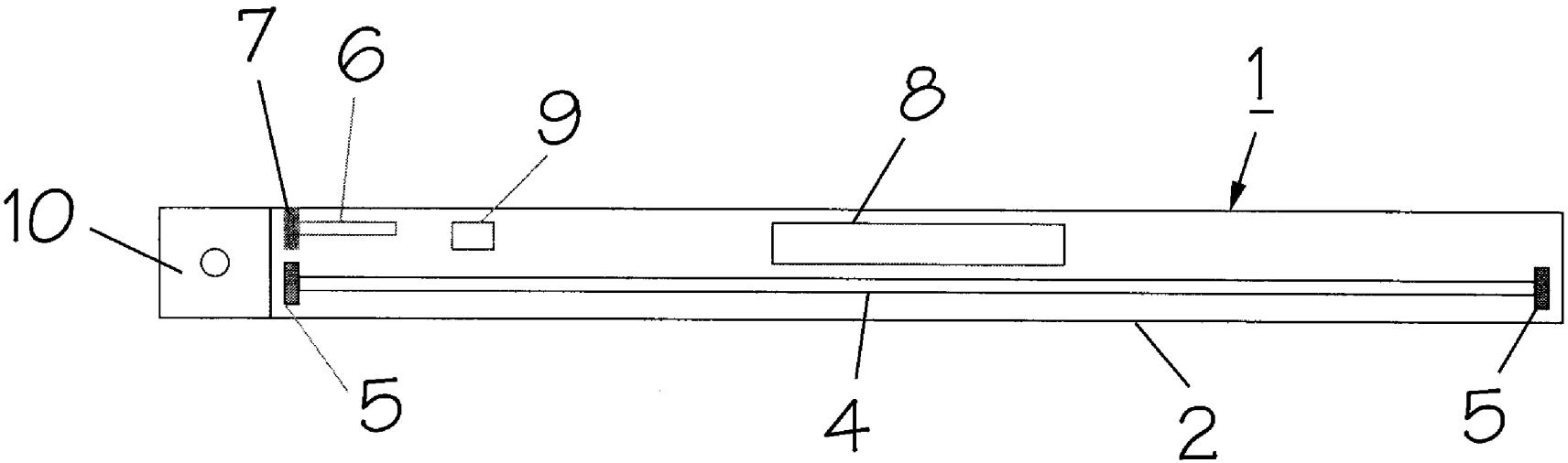
FIG. 2 is a plan view of the lighting fixture of FIG. 1 with the lens removed.

In FIGS. 1 and 2, lighting fixture 1 has a casing 2 and a lens 3. Beneath lens 3 is a 32 watt fluorescent safety light 4, held by sockets 5, and a 5 watt compact fluorescent night light 6, held by socket 7. There is also a ballast 8 for for safety light 4 and a second ballast 9 for night light 6. At one end of fixture 1 is attached a sensor 10 that can detect the presence of a person in the area lit by safety light 4.

Figure 3:
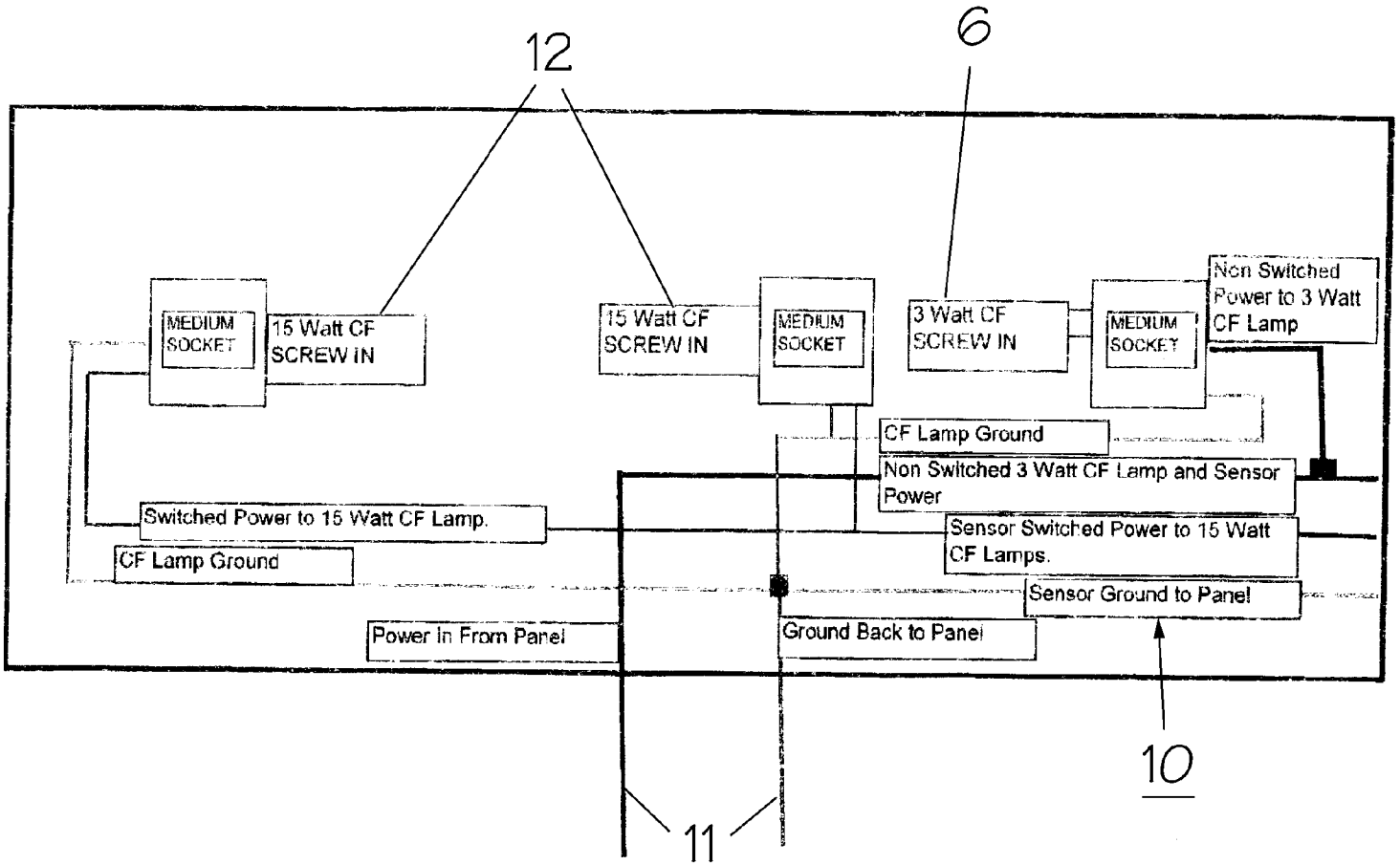
FIG. 3 is a circuit diagram of the lighting fixture according to this invention, where two bulbs are used for the safety light.

In FIG. 3, a source of electrical power 11, typically 110 VAC or 220 VAC, supplies power continuously to night light 6. Sensor 10 is connected in series with two 15 watt fluorescent safety lights 12 and turns safety lights 12 on immediately when it detects a person and turns safety lights 12 off at a predetermined interval after the person is no longer detected. That interval can be set on sensor 10, by turning a knob (not shown) to the delay desired. The delay could be set, for example, to between about 30 seconds and about 30 minutes; a delay of about 1 to about 3 minutes is preferred.

The night light of this invention preferably provides about 1 to about 2 foot candles, which meets the UCB requirement without wasting energy. A bulb of about 3 to about 7 watts is preferred for the night light and a 5 watt energy efficient fluorescent bulb is particularly preferred.

Safety light 4 emits more light than night light 6, preferably about 3 to about 4 times as much light and preferably provides about 8 to about 12 foot candles. Safety light 4 may be a single bulb or several bulbs. The total power usage of safety light 4 for one or more bulbs may be, for example, about 20 to about 40 watts. If two bulbs are used, each may be about 10 to about 18 watts. Other types of lights besides fluorescent lights may also be used, such as incandescent lights, mercury vapor lights, and sodium vapor lights.

Sensor 10 may detect the presence of a person in a variety of different ways, such as by the emission of infrared radiation (heat), by the breaking of a beam of light, by radar, etc. Preferably, it detects the presence of a person by motion. A preferred motion-detecting sensor detects the presence of a person by sensing the difference between infrared energy from a human body in motion and the background space; that sensor is available from The Watt Stopper, Inc. Preferred sensors can detect the presence of a person equally well in any direction (360°) within the space that is being lighted.

Casing 2 is typically made of metal, but may be made of other materials, such as plastic, if desired. Lens 3 protects safety light 4 and night light 6 while transmitting as much light as possible. A variety of different types of lenses may be used; a clear prismatic acrylic lens is preferred. A locking lens system may be used to make it more difficult for vandals and criminals to break the lights.

Figure 4:
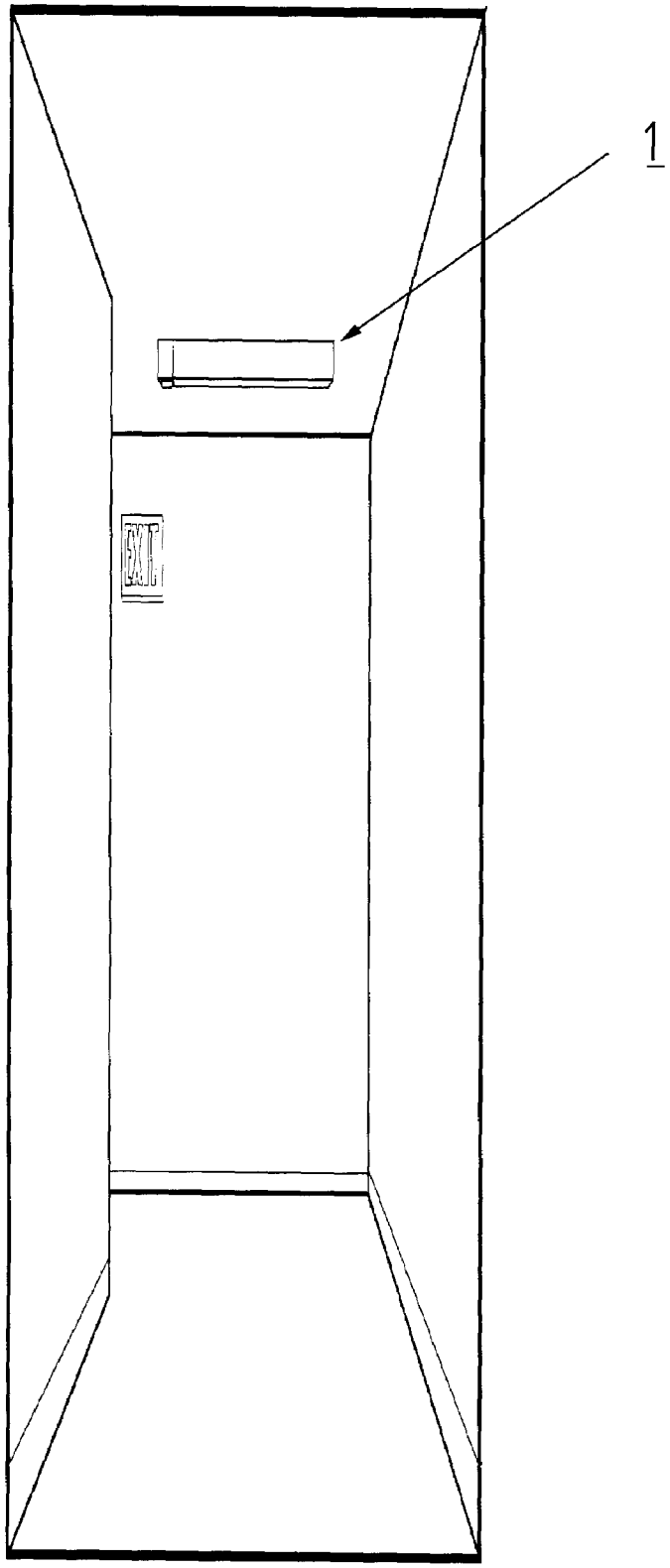
FIG. 4 is an isometric view showing the lighting fixture of FIG. 1 mounted in a corridor.
Figure 5:
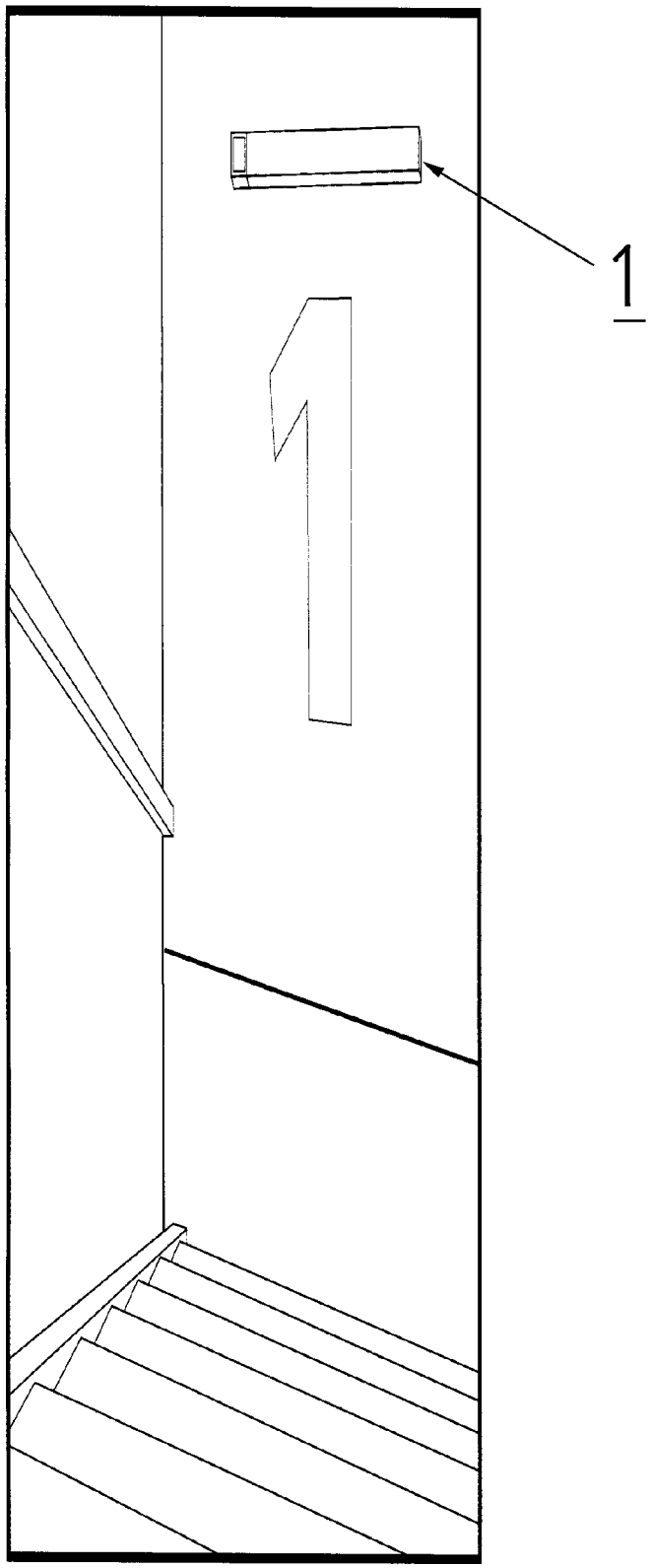
FIG. 5 is an isometric view showing the lighting fixture of FIG. 1 mounted in a stairwell.

The lighting fixtures intended primarily for use indoors, but could also be used outdoors. They are typically mounted on the ceiling in a corridor, as shown in FIG. 4, or on the wall in a stairwell, as shown in FIG. 5. In a corridor (FIG. 4), a fixture 1 may be placed on the ceiling about every 16 feet and in a stairwell (FIG. 5) a fixture 1 may be mounted on the wall at every landing. An emergency ballast (i.e., a battery) may be added to the fixture to provide power during a power outage, if desired. This technology can also be used to retrofit existing fixtures, if applicable.

The invention claimed is:

1. A lighting fixture comprising (A) a night light that is always on;

(B) a safety light that comprises two fluorescent bulbs, each of about 10 to about 18 watts, where said safety light provides more light than said night light; and (C) a sensor that detects the presence of a person within the area illuminated by said safety light and turns on said safety light when a person is detected within said area and turns off said safety light after said person is no longer detected within said area.

2. A lighting fixture according to claim 1 wherein said night light provides at least 1 foot candle of light.

3. A lighting fixture according to claim 2 wherein said night light provides 1 to about 2 foot candles of light.

4. A lighting fixture according to claim 1 wherein said night light is a fluorescent bulb of about 3 to about 7 watts.

5. A lighting fixture according to claim 1 wherein said safety light provides about 8 to about 12 foot candles of light.

6. A lighting fixture according to claim 1 wherein said safety light provides about 3 to about 4 times as much light as said night light.

7. A lighting fixture according to claim 1 wherein said sensor detects the motion of a person.

8. A lighting fixture according to claim 1 wherein said sensor senses the difference between infrared energy from a person's body in motion and background space.

9. A lighting fixture according to claim 1 wherein said sensor turns off said safety light about 30 seconds to about 30 minutes after it no longer detects the presence of a person within said area.

10. A lighting fixture according to claim 1 that has an emergency ballast.

11. A lighting fixture according to claim 1 wherein light from said night light and said safety light pass through a clear prismatic acrylic lens.

12. A corridor in a building having a lighting fixture according to claim 1 mounted therein.

13. A method of lighting a corridor in a building comprising mounting a lighting fixture according to claim 1 therein.

14. A stairwell in a building having a lighting fixture according to claim 1 mounted therein.

15. A method of lighting a stairwell in a building comprising mounting a lighting fixture according to claim 1 therein.

16. A lighting fixture comprising (A) a night light that is always on and is powered from a source of 110 VAC or 220 VAC electricity:

(B) a safety light that provides more light than said night light, comprises two bulbs that provide a total of about 8 to about 12 foot candles of light, and is powered from a source of 110 VAC or 220 VAC electricity; and (C) a sensor that detects the presence of a person within the area illuminated by said safety light and turns on said safety light when a person is detected within said area and turns off said safety light after said person is no longer detected within said area.

17. A lighting fixture according to claim 16 wherein said said safety light is fluorescent.

18. A lighting fixture comprising (A) a fluorescent night light of about 3 to about 7 watts that is always on and provides about 1 to about 2 foot candles of light;

(B) a fluorescent safety light that comprises two bulbs using a total power of about 20 to about 40 watts and providing about 8 to about 12 foot candles of light; and (C) a sensor that detects the presence of a person within the area illuminated by said safety light by sensing the difference between infrared energy from his body in motion and background space and turns on said safety light when a person is detected within said area and turns off said safety light about 1 to about 3 minutes after said person is no longer detected within said area.

* * * * *